US005857520A

United States Patent [19]

Mullen et al.

[11] Patent Number: 5,857,520

[45] Date of Patent: Jan. 12, 1999

[54] BACKUP SHOE FOR WELL PACKER

[75] Inventors: Bryon D. Mullen; James D. Hendrickson, both of Carrollton, Tex.

[73] Assignee: Halliburton Energy Services, Inc., Dallas, Tex.

[21] Appl. No.: 748,880

[22] Filed: Nov. 14, 1996

[51] Int. Cl.[6] ..... E21B 33/128

[52] U.S. Cl. ..... 166/196; 166/179; 277/584

[58] Field of Search ..... 166/118, 134, 166/202, 179, 196; 277/342, 336, 584, 619

[56] References Cited

U.S. PATENT DOCUMENTS

| | | | |
|---|---|---|---|
| 2,221,775 | 11/1940 | Boynton | 166/102 |
| 2,847,073 | 8/1958 | Arterbury et al. | 166/147 |
| 4,438,933 | 3/1984 | Zimmerman | 166/278 X |
| 4,457,369 | 7/1984 | Henderson | 166/125 |
| 4,487,258 | 12/1984 | Jackson et al. | 166/120 |
| 5,311,938 | 5/1994 | Hendrickson et al. | 166/134 |
| 5,390,737 | 2/1995 | Jacobi et al. | 166/184 |
| 5,433,269 | 7/1995 | Hendrickson | 166/134 |
| 5,701,954 | 12/1997 | Kilgore et al. | 166/119 |

FOREIGN PATENT DOCUMENTS

| | | |
|---|---|---|
| 2074630 | 3/1981 | United Kingdom . |
| 2291667 | 5/1993 | United Kingdom . |
| 2308138 | 11/1996 | United Kingdom . |

OTHER PUBLICATIONS

Baker Sand Control Gravel Pack Systems Brochure, p. 21, Undated.

*Primary Examiner*—Hoang C. Dang
*Attorney, Agent, or Firm*—Paul I. Herman; Marlin R. Smith

[57] ABSTRACT

A backup shoe for a well packer provides high pressure sealing capability without requiring a large setting force or setting stroke of the packer. In a preferred embodiment, a backup shoe has an inner portion with a relatively thin cross-section and an outer portion with a relatively thick cross-section. Additionally, the inner portion has a pivot point between its ends. In a preferred embodiment of a packer utilizing the backup shoe, an element retainer axially contacts the inner portion adjacent its pivot point, and a seal element axially contacts an inner sloping surface formed on the outer portion.

9 Claims, 9 Drawing Sheets

BACKUP SHOE FOR WELL PACKER

BACKGROUND OF INVENTION

The present invention relates generally to packers utilized in subterranean wellbores and, in a preferred embodiment thereof, more particularly provides an improved backup shoe for utilization with a well packer.

A typical packer generally has one or more seal elements or "rubbers" which are utilized to provide a fluid-tight seal radially between a mandrel of the packer and casing into which the packer is disposed. Such a packer is commonly conveyed into the casing in a subterranean wellbore suspended from tubing extending to the earth's surface.

To prevent damage to the seal elements while the packer is being conveyed into the well, the seal elements are carried on the packer mandrel in a relaxed or uncompressed state in which they are radially inwardly spaced apart from the casing. When the packer is set, the seal elements are typically axially compressed between element retainers straddling the seal elements on the packer. This axial compression of the seal elements causes them to radially inwardly and outwardly extend, thereby sealing against the packer mandrel and against the casing.

The packer usually includes a number of slips which grip the casing and prevent movement of the packer axially within the casing after the packer has been set. Thus, if weight or fluid pressure is applied to the packer, the slips resist the axial forces on the packer produced thereby, and prevent axial displacement of the packer relative to the casing.

If, however, fluid pressure is applied to an annular space radially between the packer and the casing, and above or below the seal elements, which produces a differential pressure across the seal elements, the seal elements may be displaced axially into the annular space between the packer and the casing. Additionally, the seal elements may be displaced into voids, spaces, gaps, etc. on the packer, such as into a radial gap between the element retainer and the packer mandrel. Such displacements of the seal elements may be caused by fluid pressure acting on the seal elements, or may be caused by axial compression of the seal elements when the packer is set.

It is generally undesirable for the seal elements to displace into the abovedescribed gaps, voids, etc. for a number of reasons. For example, if the seal elements displace into the radial gap between the packer and the casing, and it is later desired to retrieve the packer from the well, the presence of the seal element material in the radial gap may make it difficult to axially displace the packer in the casing. More importantly, displacement of the seal element after the packer has been set usually compromises the ability of the seal elements to effectively seal between the casing and the packer mandrel.

Several attempts have been made to solve the problem of undesired seal element displacement or extrusion in a set packer. Typically, the solution involves placing one or more anti-extrusion rings, backup rings, or backup "shoes" axially straddling the seal elements, so that the seal elements must axially traverse the rings or shoes to extrude into the gaps or voids. However, most of these attempts have met with only limited success at best.

Several of the proposed solutions to the problem involve the use of multiple rings or shoes at each axial end of the seal elements. Unfortunately, this increases the cost of the packer, increases the number of parts to inventory, increases the risk that the packer will be incorrectly assembled, etc. Additionally, where it is desired to retrieve the packer after it has been set, multiple rings or shoes increase the risk that one or more of the rings will become jammed between the packer and casing, thereby making retrieval of the packer very difficult.

Some proposed solutions utilize rings or shoes which displace radially outward to contact the casing when the packer is set in an attempt to close off the radial gap between the packer and the casing. Most of these do not also displace radially inward to close off the gap between the element retainers and the packer mandrel, nor do they close off any other gaps or voids on the packer into which the seal elements may displace. This situation is particularly undesirable where seal element material is utilized, such as Aflas, that readily flows into gaps and voids under pressure. In addition, these solutions also suffer from the risk that they will not radially inwardly retract when it is desired to retrieve the packer from the casing.

Still other proposed solutions utilize rings or shoes which have an angled thick outer portion which must be forced outward to contact the casing. The thick outer portion is designed to withstand larger forces applied thereto than could be applied to thinner portions. Unfortunately, these solutions also require large setting forces to be applied to the packer in order to force the thick outer portions radially outward. In attempts to decrease these large setting forces, some have increased an axial distance between the thick outer portion and the seal element, and provided a ramp or extended lever arm therebetween. These attempts have indeed decreased the required setting force, but have consequently increased the axial travel required to compress the seal elements and set the packer.

From the foregoing, it can be seen that it would be quite desirable to provide a well packer with improved backup shoes which do not significantly increase the cost of the packer, increase the risk of improper assembly, require large setting forces or axial travel for setting of the packer, or hamper retrieval of the packer, but which prevent displacement of seal elements into a radial gap between the packer and casing in which it is set, prevent displacement of seal elements into a gap between element retainers and a mandrel of the packer, prevent displacement of seal elements into other voids and gaps on the packer, and which provide a relatively thick outer portion for resistance to relatively large forces applied thereto. It is accordingly an object of the present invention to provide such improved backup shoes and a well packer utilizing such backup shoes.

SUMMARY OF THE INVENTION

In carrying out the principles of the present invention, in accordance with an embodiment thereof, a backup shoe is provided which is a single element backup shoe, utilization of which does not require large setting forces or setting stroke, but which is capable of withstanding large axial loads applied thereto and completely closing off any gaps between a mandrel on which it is installed and an external tubular structure. In accordance with another embodiment of the present invention, a packer is provided which is easily retrievable, is capable of sealing against relatively high pressures, and which utilizes the disclosed backup shoe.

In broad terms, a backup shoe is provided which includes an outer ring-shaped portion and an inner ring-shaped portion. The inner portion is integrally formed with the outer portion, and the inner portion has a cross-section thinner than a cross-section of the outer portion. The inner portion has a pivot point formed between its opposite ends. In the disclosed embodiment, the inner portion cross-section extends orthogonally, and then slopingly, relative to its axis, and the outer portion cross-section is generally triangular-shaped.

In another aspect of the present invention, a backup shoe is provided for use with a downhole tool of the type having at least two axially spaced apart element retainers, the element retainers having opposing surfaces formed thereon, and one or both of the opposing surfaces being capable of axially displacing relative to the other one of them. At least one seal element is disposed axially between the opposing surfaces, and at least one of the element retainers is axially slidingly disposed circumferentially about a mandrel of the downhole tool.

The backup shoe includes an inner annular portion having a cross-section extending radially outward. The inner portion is capable of being axially slidingly disposed circumferentially about the mandrel axially between one of the opposing surfaces and the seal element, such that the inner portion axially contacts one of the opposing surfaces.

An intermediate annular portion of the backup shoe has a cross-section extending axially slopingly outward from the inner portion. The intermediate portion is integrally formed with the inner portion, and the intermediate portion extends axially slopingly away from one of the opposing surfaces when the inner portion axially contacts it. In this manner, a pivot point is formed at the juncture of the inner and intermediate portions.

An outer annular portion of the backup shoe is integrally formed with the intermediate portion. The outer portion extends axially away from one of the opposing surfaces when the inner portion axially contacts it. The outer portion has a generally thicker cross-section as compared to cross-sections of the inner and intermediate portions. When the backup shoe is pivoted about its pivot point, the inner portion radially contacts the mandrel and the outer portion radially contacts a tubular structure in which the downhole tool is disposed.

DETAILED DESCRIPTION

Figure 1:
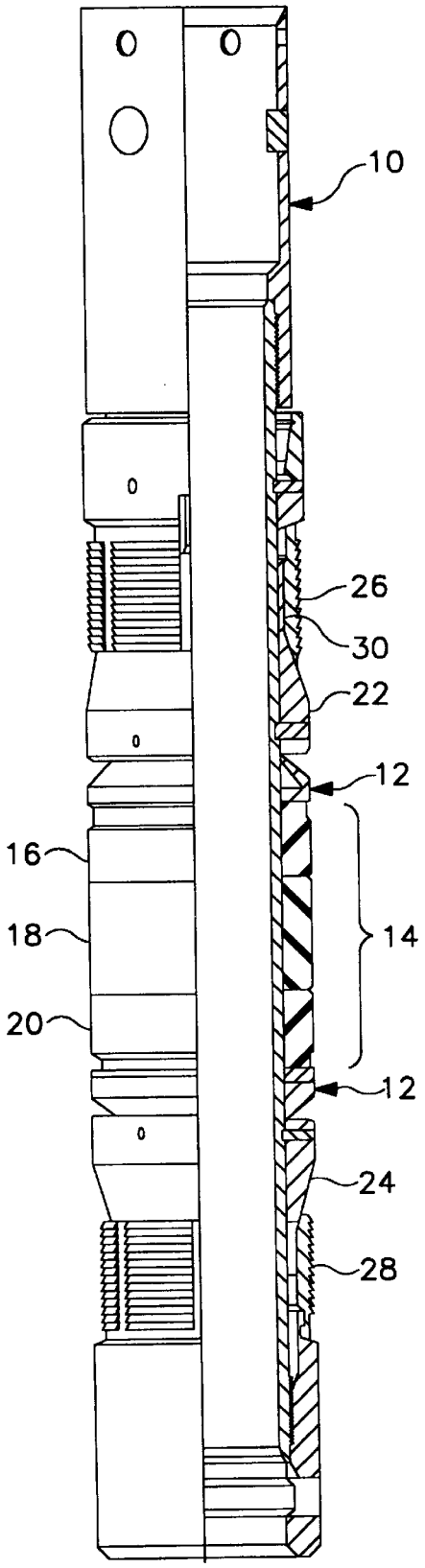
FIG. 1 PRIOR ART
FIG. 1 (PRIOR ART) is a partially elevational and partially cross-sectional view of a prior art packer.

Illustrated in FIG. 1 (PRIOR ART) is a packer 10 which includes backup shoes 12 axially straddling a seal 14. The seal 14 includes three seal elements 16, 18, 20, but the seal may also have a larger or smaller number of seal elements. Axially straddling the backup shoes 12 are two element retainers 22, 24, which are axially inwardly displaced relative to each other when the packer 10 is set. When one of the element retainers 22, 24 displaces axially toward the other one of them, the backup shoes 12 and the seal 14 are axially compressed therebetween, thereby forcing the seal to extend radially outward. For convenience of description, when element retainers are described herein as axially displacing relative to each other, it is to be understood that only one, or both, of the element retainers may actually displace relative to the remainder of the downhole tool on which they are carried.

Axially straddling the seal 14, backup shoes 12, and element retainers 22, 24 are casing slips 26, 28. The slips 26, 28 radially outwardly extend when the packer 10 is set, in order to grip casing (not shown) surrounding the packer and anchor the packer to the casing. In this manner, the packer 10 is prevented from axially displacing relative to the casing.

The slips 26, 28, element retainers 22, 24, backup shoes 12, and seal 14 are carried externally on an axially extending and generally tubular mandrel 30. When the packer 10 is set, it is desired for the seal 14 to extend radially from the mandrel 30 to the casing, in order to prevent axial fluid communication thereacross. In other words, the seal 14 closes off an annular fluid passage between the packer 10 and the casing when the packer is set in the casing.

The packer 10 and other prior art packers described hereinbelow are shown herein as examples of types of downhole tools on which backup shoes of the present invention may be utilized advantageously. It is to be understood, however, that backup shoes made according to principles of the present invention may be utilized on a variety of downhole tools, including plugs, tubing hangers, casing patches, permanent packers, retrievable packers, hydraulic set packers, mechanical set packers, wireline set packers, tubing set packers, other types of packers, etc. The packer 10 is also shown herein to illustrate disadvantages of prior art packers and backup shoes, such as backup shoes 12, which are eliminated by the principles of the present invention.

Figure 2A:
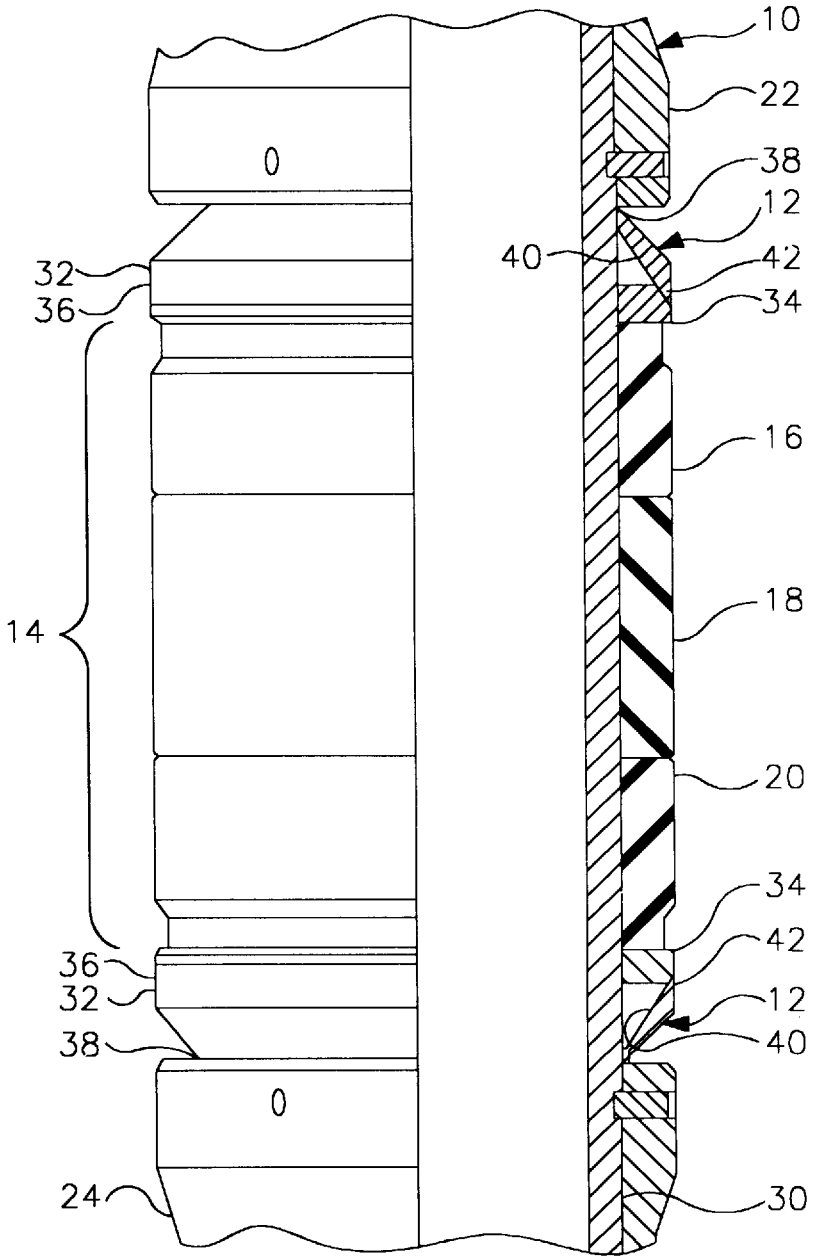
FIG. 2A PRIOR ART
FIGS. 2A–2D) (PRIOR ART) are partially elevationial and partially cross-sectional views of prior art backup shoes.

Referring additionally now to FIGS. 2A–2D (PRIOR ART), various prior art packers and backup shoes included therewith are shown. FIG. 2A shows an enlarged view of an axial portion of the packer 10 of FIG. 1. In this view it may be clearly seen that each of the backup shoes 12 includes two elements—a generally triangular cross-sectioned outer ring 32 and a generally rectangular cross-sectioned inner ring 34.

It will be readily appreciated by one of ordinary skill in the art that, as the element retainers 22, 24 are displaced axially toward each other while the packer 10 is being set, the outer rings 32 will eventually be forced to deform into a more laterally disposed configuration in which an upper end 36 of each of the rings is made to extend radially outward. This is due to the fact that the outer rings 32 are axially compressed between the element retainers 24 and the inner rings 34. Note that, as the upper ends 36 extend radially outward, the outer rings 32 pivot about points 38 where the outer rings axially contact the element retainers 22, 24. To aid in pivoting the outer rings 32, as the outer rings pivot, inner sloping surfaces 40 formed on the rings axially contact outer sloping surfaces 42 formed externally in the inner rings 34.

It may now be appreciated that the backup shoes 12 have a number of disadvantages associated therewith. For example, the backup shoes 12 include multiple elements 32, 34, making them more costly to manufacture and inventory than a single element. As another example, each of the multiple elements must be assembled onto the packer 10 in a particular orientation, thereby multiplying the number of possibilities of incorrectly assembling the packer. As yet another example, the backup shoes 12 require a relatively large axial force to cause them to pivot about the pivot points 38. As still another example, the backup shoes 12 require a large axial displacement of the element retainers 22, 24 in order to radially outwardly extend the outer ends 36 to contact the casing. Thus, the backup shoes 12 unduly contribute to what is known as the setting stroke of the packer 10 by those skilled in the art. Yet another disadvantage of the backup shoes 12 is that they are difficult to disengage from the casing (i.e., pivot back so that the outer ends 36 are radially spaced apart from the casing) sufficiently far so that the packer 10 may be easily retrieved from the casing.

Figure 2B:
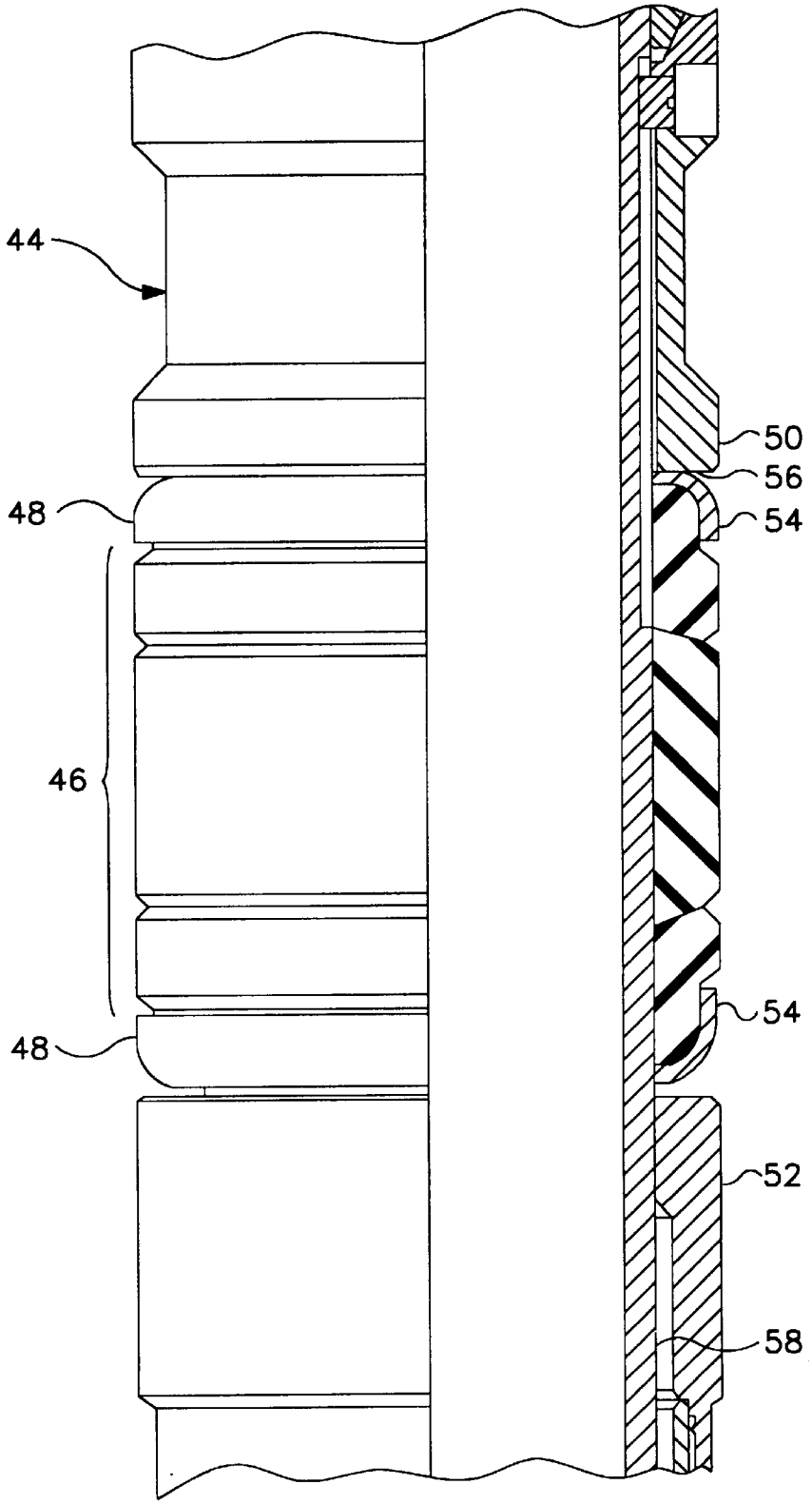
FIG. 2B PRIOR ART

In FIG. 2B, an axial portion of a prior art packer 44 is shown. The packer 44 includes a seal 46 with backup shoes 48 axially straddling and partially outwardly overlapping the seal. Element retainers 50, 52 axially straddle the backup shoes 48.

When the packer 44 is set, element retainers 50, 52 are displaced axially toward each other, thereby axially compressing the seal 46 and backup shoes 48 therebetween. Such axial compression of the seal 46 causes it to extend radially outward to seal against casing (not shown) in which the packer 44 is set. Axial compression of the backup shoes 48 between the element retainers 50, 52 and the seal 46 causes the backup shoes to deform so that an outer end 54 is radially outwardly extended to contact the casing. In deforming the backup shoes 48, each of them is made to pivot about a point 56 where the backup shoe transitions from contact with one of the element retainers 50, 52 to being axially and radially outwardly spaced apart therefrom. Although, as viewed in FIG. 2B, the lower backup shoe 54 is completely spaced apart from the lower element retainer 52, it may be easily seen that axial contact therebetween will occur when the element retainers 50, 52 are displaced axially toward each other. Due to the fact that the backup shoes 54 have generally quarter-circular cross-sections, the pivot points 56 will radially outwardly displace as the backup shoes pivot about the pivot points.

It may now be appreciated that the backup shoes 48 have a number of disadvantages associated therewith. For example, as the packer 44 is set, the backup shoes 48 require an increasingly larger axial force to cause them to pivot about the pivot points 56. This is because the distance between the ends 54 and the pivot points 56 (which is the lever arm used to deform the backup shoes about the pivot points) decreases as the packer 44 is set. It is instructive to compare the lever arm of the backup shoes 48 to that of the backup shoes 12 of FIG. 2A. As another example, the backup shoes are difficult to disengage from the casing (i.e., pivot back so that the outer ends 54 are radially spaced apart from the casing) sufficiently far so that the packer 44 may be easily retrieved from the casing. As yet another example, the backup shoes 48 tend to displace radially outward as they pivot about the pivot points 56, causing an increasingly large radial gap between each of the backup shoes and a mandrel 58 of the packer 44. This radial gap between each of the backup shoes 48 and the mandrel 58 provides a void into which the seal 46 may extrude, thereby compromising the ability of the seal to effectively sealingly engage the casing or mandrel. As still another example, the cross-section of each of the backup shoes 48 is relatively thin at the outer end 54, limiting its ability to resist large axial forces applied thereto, such as when the seal 46 is called upon to seal against relatively high differential pressure.

Figure 2C:
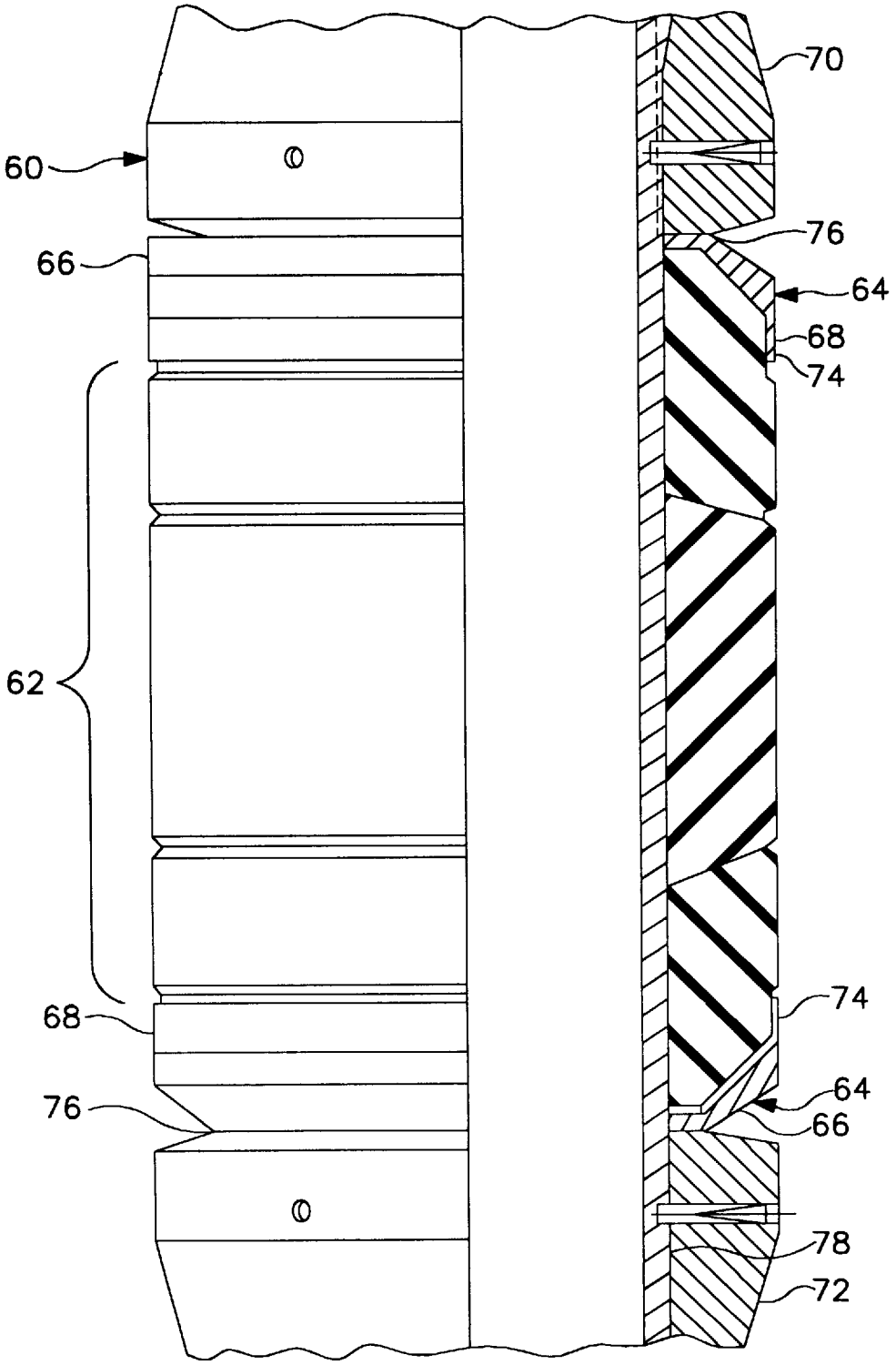
FIG. 2C PRIOR ART

FIG. 2C shows an axial portion of another prior art packer 60. The packer 60 includes a seal 62 with backup shoes 64 axially straddling and partially outwardly overlapping the seal. Each of the backup shoes 64 includes an inner relatively thin cross-sectioned ring 68, and an outer ring 06 which somewhat radially outwardly overlaps the inner ring. The outer rings 66 axially straddle the inner rings 68. Element retainers axially straddle the backup shoes 64.

When the packer 60 is set, element retainers 70, 72 are displaced axially toward each other, thereby axially compressing the seal 62 and backup shoes 64 therebetween. Such axial compression of the seal 62 causes it to extend radially outward to seal against casing (not shown) in which the packer 60 is set. Axial compression of the backup shoes 64 between the element retainers 70, 72 and the seal 62 causes the backup shoes to deform so that an outer end 74 of each of the inner rings 68 is radially outwardly extended to contact the casing. In deforming the backup shoes 64, each of the inner and outer rings 66, 68 is made to pivot about a point 76 where the outer ring 66 transitions from contact with one of the element retainers 70, 72 to being axially and radially outwardly spaced apart therefrom. Note that, at least in an area proximate the pivot point 76, each of the inner rings 68 is complementarily shaped relative to each of the outer rings 66.

Unlike the backup shoes 48 of FIG. 28, however, the pivot points 76 do not radially outwardly displace as the backup shoes are deformed about the pivot points. With this exception, the inner rings 68 operate similarly to the backup shoes 48. The addition of the outer rings 66 enables the backup shoes 64 to resist greater axial force applied thereto as compared to the backup shoes 48.

Nevertheless, the backup shoes 64 do have a number of disadvantages associated therewith. For example, the backup shoes 64 are difficult to disengage from the casing (i.e., pivot back so that the outer ends 74 are radially spaced apart from the casing) sufficiently far so that the packer 60 may be easily retrieved from the casing. As another example, the inner rings 68 tend to displace radially outward as they pivot about the pivot points 76, causing an increasingly large radial gap between each of the inner rings and a mandrel 78 of the packer 60. This radial gap between each of the inner rings 68 and the mandrel 78 provides a void into which the seal 62 may extrude, thereby compromising the ability of the seal to effectively sealingly engage the casing or mandrel. As yet another example, the backup shoes 64 include multiple elements 66, 68, making them more costly to manufacture and inventory than a single element. As still another example, each of the multiple elements must be assembled onto the packer 60 in a particular orientation, thereby multiplying the number of possibilities of incorrectly assembling the packer. As yet another example, the backup shoes 64 have a relatively short lever arm, thereby requiring a relatively large packer setting force to properly set the packer 60.

Figure 2D:
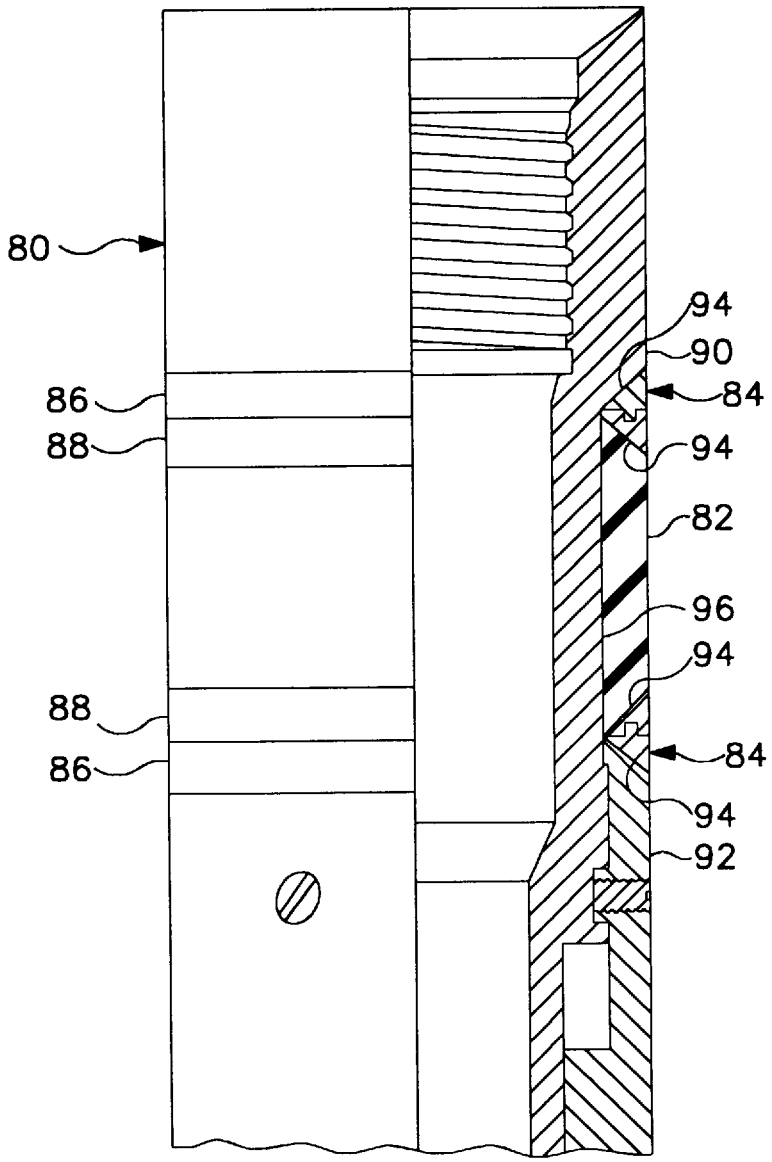
FIG. 2D PRIOR ART

FIG. 2D shows an axial portion of yet another prior art packer 80. The packer 80 includes a single element seal 82 with backup shoes 84 axially straddling and partially outwardly overlapping the seal. Each of the backup shoes 84 includes an inner generally triangular cross-sectioned ring 88 and an outer generally triangular cross-sectioned ring 86. The outer rings 86 axially straddle the inner rings 88. Element retainers 90, 92 axially straddle the backup shoes 84.

When the packer 80 is set, element retainers 90, 92 are displaced axially toward each other, thereby axially compressing the seal 82 therebetween. Such axial compression of the seal 62 causes it to extend radially outward to seal against casing (not shown) in which the packer 80 is set. Axial compression forces applied to sloping surfaces 94 formed on the backup shoes 84 between the element retainers 90, 92 and the seal 82 causes the backup shoes to displace radially outward to contact the casing. In displacing radially outward, note that the backup shoes 84 space apart from a mandrel 96 of the packer 80 (the mandrel being integrally formed with the upper element retainer 90), thereby requiring the seal 82 to fill a void left radially between the backup shoes and the mandrel.

It will be readily appreciated that the backup shoes 84 have several disadvantages associated therewith. For example, the backup shoes 84 are difficult to disengage from the casing (i.e., so that the backup shoes are radially spaced apart from the casing) sufficiently far so that the packer 80 may be easily retrieved from the casing. This operation is made particularly difficult since the seal 82 fills the void left when the backup shoes were radially outwardly displaced as the packer was set in the casing. As another example, the backup shoes 84 displace radially outward as the packer 80 sets, thereby requiring the seal 82 to be compressed more axially to fill the void left by the shoes. As yet another example, the backup shoes 84 include multiple elements 86, 88, making them more costly to manufacture and inventory than a single element. As another example, each of the multiple elements must be assembled onto the packer 80 in a particular orientation, thereby multiplying the number of possibilities of incorrectly assembling the packer.

Figure 3:
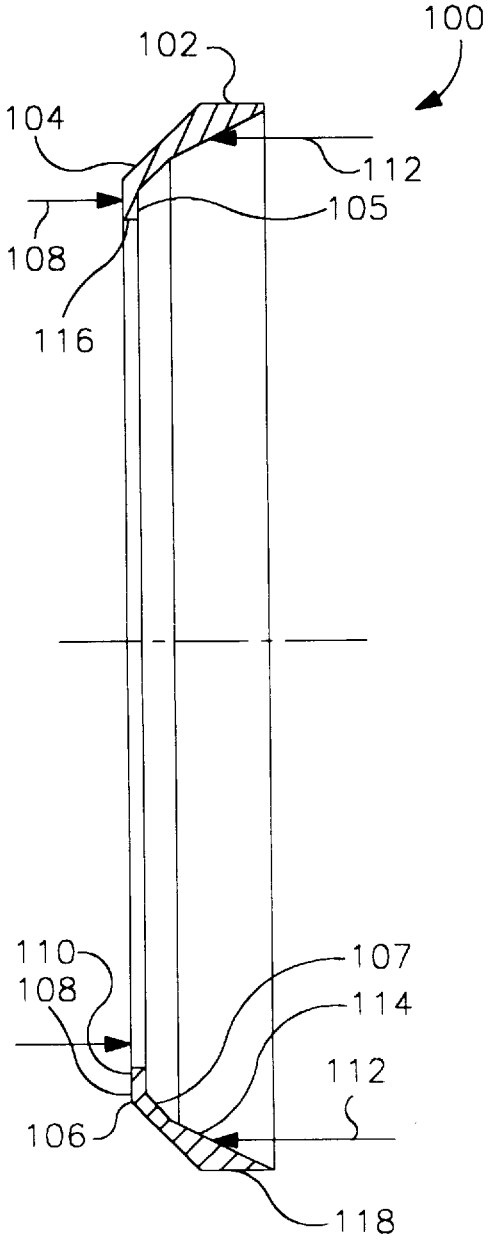
FIG. 3 is a cross-sectionial view of a backup shoe embodying principles of the present invention.

Turning now to FIG. 3, a backup shoe 100 embodying principles of the present invention is representatively illustrated. The backup shoe 100 includes an outer portion 102 having a generally triangular shaped cross-section, and an inner portion 104 integrally formed therewith. The inner portion 104 includes a first radially extending portion 105 and a second portion 107 which is sloped relative to its axis.

Note that the cross-section of the inner portion 104 is generally constant in thickness and is not linear, but has a pivot point 106 between its opposite ends. As will be more fully described hereinbelow, the pivot point 106 is the point on the inner portion 104 about which the backup shoe 100 will pivot if an axial force (represented by arrows 108 in FIG. 3) is applied to an outer face 11 (for example, by an element retainer) formed on the inner portion while an oppositely directed force (represented by arrows 112 in FIG. 3) is applied to an inner sloping face 114 formed on the outer portion 102 (for example, by a seal).

The outer portion 102 is generally relatively thicker in cross-section than is the cross-section of the inner portion 104. Thus, when the forces 108, 112 are applied to the backup shoe 100, it tends to bend most readily at the pivot point 106 located in the relatively thin inner portion 104. It will also be readily appreciated by those of ordinary skill in the art that, when the forces 108, 112 are applied to deform the backup shoe 100, and as it pivots about the pivot point 106, an inner end 116 of the backup shoe will be thereby displaced radially inwardly and an outer end 118 will be thereby displaced radially outwardly. Such radial displacements of the inner and outer ends 116, 118 have been confirmed in tests performed by applicants.

Applicants prefer that the backup shoe 100 be formed of a ductile and relatively high strength material, such as AISI 1018 steel. However, it is to be understood that other steels and other materials, such as brass, plastics, etc., may be utilized in constructing the backup shoe 100 without departing from the principles of the present invention.

Figure 4:
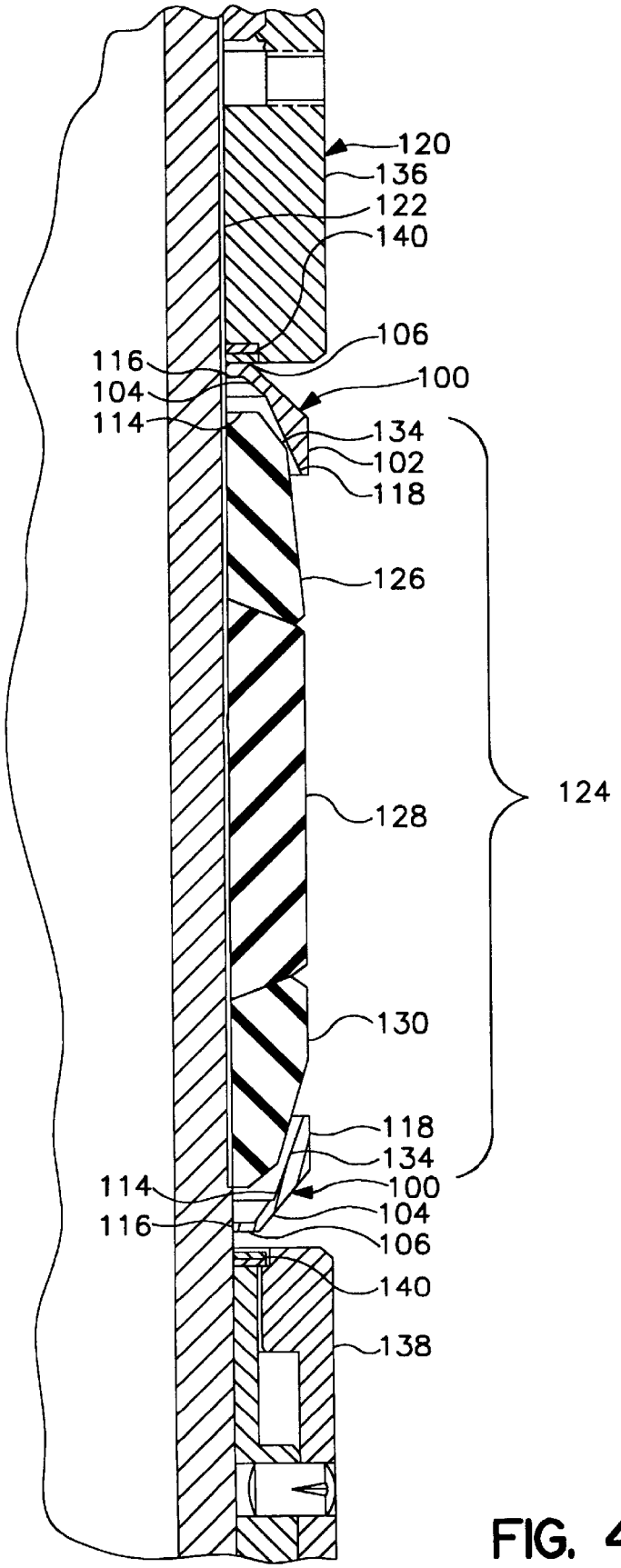
FIG. 4 is a cross-sectional view of the backup shoes of FIG. 3 operatively installed on an axial portion of a retrievable packer, the packer embodying principles of the present invention.

Referring additionally now to FIG. 4, two backup shoes 100 are representatively illustrated operatively installed on an axial portion of a packer 120, the packer embodying principles of the present invention. In many respects, the packer 120 is similar to a Versa-Trieve® packer manufactured by, and available from, Halliburton Energy Services of Duncan, Okla. and well known to those of ordinary skill in the art. Various features of similar packers are described in U.S. Pat. No. 5,311,938, the disclosure of which is hereby incorporated herein by this reference.

In the following detailed description of the backup shoe 100 and the packer 120, directional terms, such as "upper", "lower", "upward", "downward", etc. are used for convenience in referring to the accompanying drawings. It is to be understood that the backup shoes 100 and elements of the packer 120 may be utilized in various orientations, such as horizontal, vertical, and inclined orientations. Additionally, although the packer 120 representatively illustrated in the accompanying figures is similar to the Versa-Trieve® packer, it is to be clearly understood that other packers may be utilized without departing from the principles of the present invention.

The backup shoes 100 are shown in FIG. 4 installed on a generally tubular mandrel 122. A seal 124 which includes upper, middle, and lower seal elements 126, 128, and 130, respectively, is installed on the mandrel 122 axially between the backup shoes 100. Note that the backup shoes 100 partially radially overlap the upper and lower seal elements 126, 130. It is to be clearly understood that the seal elements 126, 128, and 130 could be a single element, or could be a larger or smaller number of elements without departing from the principles of the present invention.

In one feature of the present invention, the upper and lower seal elements 126, 130 are not complementarily shaped relative to inner surfaces 114 of the backup shoes. Instead, the upper and lower seal elements 126, 130 axially contact the inner surfaces 114 at points 134 axially, and radially spaced apart from the inner and outer ends 116, 118 of the backup shoes. It will also be readily appreciated that the contact points are axially and radially spaced apart from the pivot points 106. Note that the upper and lower seal elements 126, 130 do not axially contact the inner portions 104 of the backup shoes 100.

The packer 120 includes upper and lower element retainers 136, 138, respectively, which axially straddle the backup shoes 100. When the packer 120 is set, the axial distance between the upper and lower element retainers 136, 138 is compressed, thereby axially compressing the backup shoes 100 and seal 124 therebetween. Spirolox® rings 140, well known to those ordinarily skilled in the art, are disposed on the mandrel 122 adjacent the element retainers 136, 138 for additional protection against extrusion of the seal 124 between the element retainers and the mandrel 122.

Figure 5:
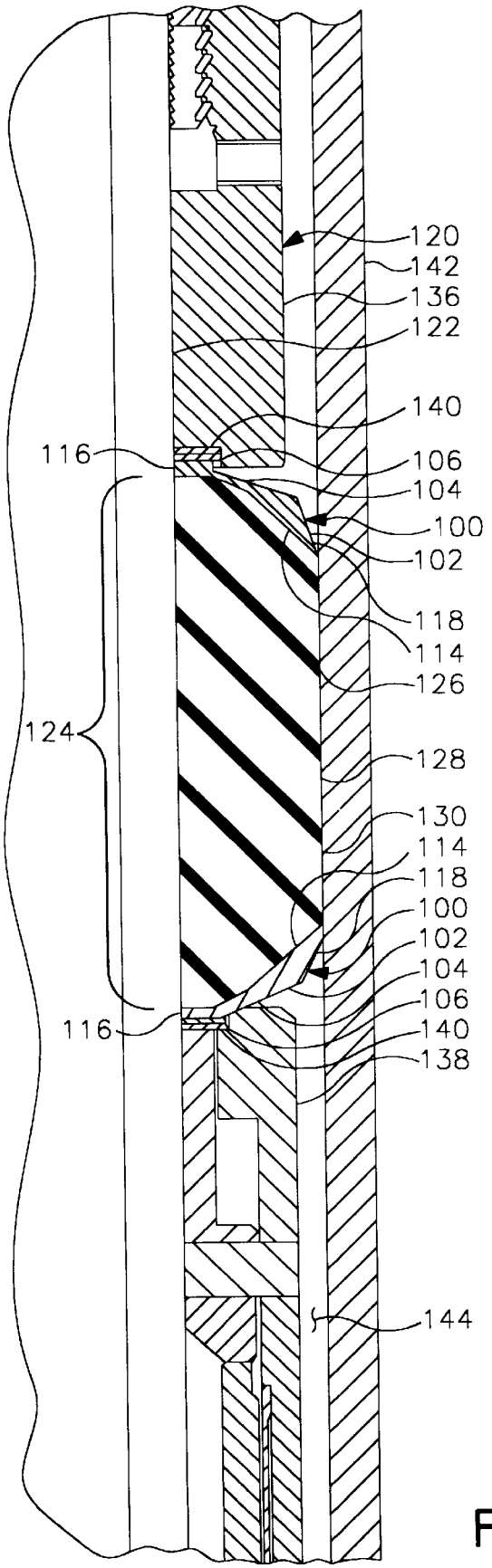
FIG. 5 is a cross-sectional view of the axial portion of the packer of FIG. 4, showing the packer set in casing, wherein the backup shoes operatively engage the casing and a mandrel and seal elements of the packer.

Referring additionally now to FIG. 5, the packer 120 is representatively illustrated as being disposed within a casing 142, the packer having been set therein so that the seal 124 is radially outwardly extended to sealingly engage the casing. The seal 124 also sealingly engages the mandrel 122. Note that the backup shoes 100 form continuous barriers radially between the casing 142 and the mandrel 122, contacting each of them, and thereby preventing extrusion of the seal 124. No voids, gaps, etc. on the packer 120 are available for the seal 124 to flow into. Even small voids about the Spirolox® rings 140 are closed off by the backup shoes 100. The seal 124 is, thus, completely contained by the casing 142, mandrel 122 , and backup shoes 100.

Note also, that the outer portions 102 extend radially between the element retainers 136, 138 and the casing 142, thereby bridging the radial gap therebetween. For this reason, the outer portions 102 are relatively thick in cross-section. The thicknesses of the outer portion 102 cross-sections are sufficient to resist relatively high axial forces applied thereto, for example, by high fluid pressure differentials from above or below in an annular gap 144 radially between the element retainers 136, 138 and the casing 142.

In contrast, the inner portions 104 are relatively easily deformed by the axially compressive forces generated by setting of the packer 120. Thus, the packer 120 does not require high setting forces. Nor is a large setting stroke required to set the packer 120.

As described hereinabove, as the packer 120 is set, the backup shoes 100 are deformed so that they pivot or bend about their pivot points 106. As they pivot about the pivot points 106, the inner ends 116 are forced into radial contact with the mandrel 122, and the outer ends 118 are forced into radial contact with the casing 142. The inner surfaces 132 then form axial barriers for the seal 124.

Figure 6:
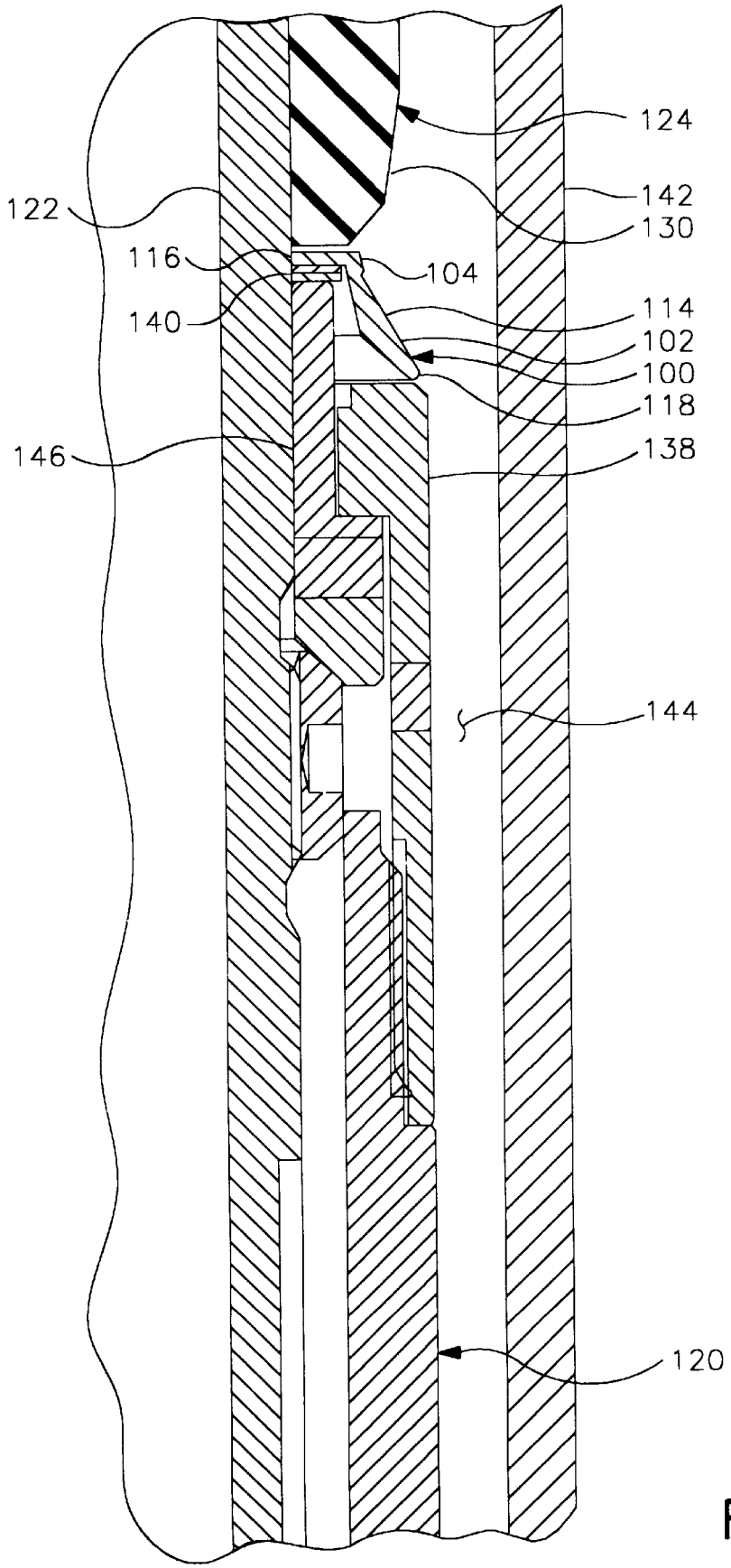
FIG. 6 is a cross-sectional view of another axial portion of the packer of FIG. 4, showing the packer configured for retrieval thereof, wherein the backup shoes are disengaged from the casing.

Referring additionally now to FIG. 6, the packer 120 is shown in a retrieving configuration in which the seal 124 is radially inwardly contracted out of sealing engagement with the casing 142 and the backup shoe 100 outer end 118 is displaced radially inwardly away from the casing. Only the lower seal element 130 and backup shoe 100 are shown in the axial portion of the packer 120 representatively illustrated in FIG. 6 for convenience, since, with the packer 120, only the lower backup shoe outer end 118 may be radially inwardly displaced. However, it is to be understood that the packer 120 could be modified to permit radially inward displacement of the upper backup shoe outer end 118 without departing from the principles of the present invention. As will be readily appreciated by one ordinarily skilled in the art, the packer 120 does not include provision for radially inwardly displacing the upper backup shoe outer end 118, since the packer is normally retrieved upwardly from the casing 142 and, therefore, the upper backup shoe 100 presents no impediment to such retrieval, the upper backup shoe being sloped axially downward between the packer and the gasing.

Note that the inner portion 104 has been deformed so that it now is bent opposite to that shown in FIGS. 3–5. Such deformation of the inner portion 104 is easily accomplished by a retainer ring portion 146 (which is similar to the retainer ring 66 described in U.S. Pat. No. 5,311,938) of the lower element retainer 138. Accordingly, the relatively thinner cross-section of the inner portion 104, integrally, formed with the relatively thicker cross-section of the outer portion 102, enables the backup shoe 100 to be conveniently radially inwardly retracted out of engagement with the casing 142.

Thus has been described the backup shoe 100 which is economical to manufacture, integrally constructed, convenient in its operation, easing to assemble into a packer, convenient to inventory, capable of withstanding relatively high axial fores applied thereto, which provides a continuous barrier for a packer seal, closing off all gaps and voids between casing and a packer mandrel onto which it is installed, which presents no difficulty in radially inwardly retracting after the packer has been set in the casing, does not require a large setting force of the packer, does not require a large setting stroke of the packer, and which may be utilized advantageously on a variety of downhole well tools. In addition, a packer 120 has been described which incorporates the backup shoe 100, derives the benefits thereof, and which includes the seal 124 which is configured for cooperative engagement with the backup shoe 100. These and other benefits are provided by the principles of the present invention.

That the backup shoe 100 and packer 120 disclosed hereinabove provides the above benefits may be confirmed by comparison of the backup shoe and packer with those disclosed in U.S. Pat. Nos. 4,457,369, 5,311,938, and 5,433,269. The disclosures contained in these patents are hereby incorporated herein by this reference.

Of course, modifications may be made to the specific embodiments described hereinabove without departing from the principles of the present invention. Therefore, the foregoing detailed description is to be clearly understood as being given by way of illustration and example only, the spirit and scope of the present invention being limited solely by the appended claims.

What is claimed is:

1. A downhole tool, comprising:

an axially extending mandrel;

at least two axially spaced apart element retainers, the element retainers having opposing surfaces formed thereon, and at least one of the element retainers being axially slidingly disposed relative to the mandrel to thereby axially displace at least one of the opposing surfaces relative to the other opposing surface;

at least one seal element disposed axially between the opposing surfaces; and a backup shoe, the backup shoe including:

first inner annular portion having a cross-section extending radially outward, the first portion being axially slidingly disposed circumferentially about the mandrel axially between one of the opposing surfaces and the seal element, the first portion directly contacting the one of the opposing surfaces, and the first portion directly contacting the seal element when the one of the opposing surfaces is displaced relative to the other opposing surface;

a second intermediate annular portion having a cross-section extending axially slopingly outward from the first portion, the second portion being integrally formed with the first portion, and the second portion extending axially slopingly away from the one of the opposing surfaces; and a third outer annular portion integrally formed with the second portion, the third portion extending axially away from the one of the opposing surfaces.

2. The downhole tool according to claim 1, wherein the third portion has a cross-section generally thicker than the second portion cross-section and the first portion cross-section.

3. The downhole tool according to claim 1, wherein the first portion cross-section is generally rectangular-shaped, wherein the second portion cross-section is generally rectangular-shaped, and wherein the third portion has a generally triangular-shaped cross-section.

4. The downhole tool according to claim 1, wherein the first portion cross-section and the second portion cross-section have generally similar thickness.

5. The downhole tool according to claim 1, wherein the third portion has an inner axially sloping surface formed thereon, the sloping surface axially contacting the seal element when the first portion axially contacts the one of the opposing surfaces and the opposing surfaces are axially displaced relative to each other.

6. The downhole tool according to claim 5, wherein the backup shoe only contacts the seal element at the sloping surface when the first portion axially contacts the one of the opposing surfaces, the opposing surfaces are axially displaced relative to each other, and before the seal element is axially compressed.

7. The downhole tool according to claim 1, wherein the downhole tool is axially disposable within a tubular structure, wherein the seal element is axially compressed between the element retainer opposing surfaces when at least one of the opposing surfaces is axially displaced relative to the other opposing surface, and wherein the first portion radially contacts the mandrel and the third portion radially contacts the tubular structure when the seal element is axially compressed within the tubular structure.

8. A well tool, comprising:

first and second members, at least one of the members being axially displaceable relative to the other member;

at least one seal element positioned axially between the members, the seal element being axially compressed between the members when at least one of the members is axially displaced relative to the other member; and a backup shoe including first and second annular portions, the first portion having a generally constant cross-sectional thickness between opposite ends thereof, and the first portion further having at least one pivot point between its opposite ends, the second portion being attached to the first portion at one of the opposite ends and having a cross-sectional thickness generally greater than that of the first portion, an inclined inner side surface of the second portion directly contacting the seal element.

9. A well tool, comprising:

first and second members, at least one of the members being axially displaceable relative to the other member;

at least one seal element positioned axially between the members, the seal element being axially compressed between the members when at least one of the members is axially displaced relative to the other member; and a backup shoe directly contacting the seal element and one of the members, the backup shoe including first and second annular portions, the first portion having a generally constant cross-sectional thickness between opposite ends thereof, and the first portion further having at least one pivot point between its opposite ends, the second portion being attached to the first portion at one of the opposite ends and having a cross-sectional thickness generally greater than that of the first portion.

* * * * *